US009103595B2

(12) United States Patent
Ciurkot

(10) Patent No.: US 9,103,595 B2
(45) Date of Patent: Aug. 11, 2015

(54) SHRINK WRAP TUNNEL WITH DYNAMIC WIDTH ADJUSTMENT

(71) Applicant: Arpac, LLC, Schiller Park, IL (US)

(72) Inventor: Janusz Ciurkot, Palatine, IL (US)

(73) Assignee: ARPAC, LLC, Schiller Park, IL (US)

( * ) Notice: Subject to any disclaimer, the term of this patent is extended or adjusted under 35 U.S.C. 154(b) by 174 days.

(21) Appl. No.: 13/826,639

(22) Filed: Mar. 14, 2013

(65) Prior Publication Data

US 2014/0272747 A1 Sep. 18, 2014

(51) Int. Cl.

| | |
|---|---|
| ***B65B 53/02*** | (2006.01) |
| ***F27D 3/12*** | (2006.01) |
| ***B65B 53/06*** | (2006.01) |
| ***B65B 59/02*** | (2006.01) |
| ***B65B 65/06*** | (2006.01) |

(52) U.S. Cl.

CPC ..... *F27D 3/12* (2013.01); *B65B 53/063* (2013.01); *B65B 59/02* (2013.01); *B65B 65/06* (2013.01)

(58) Field of Classification Search

CPC ..... B65B 53/063
USPC ..... 432/121, 128, 133, 136, 137, 153, 242; 53/48.2, 557, 441, 442; 34/212, 242, 34/381

See application file for complete search history.

(56) References Cited

U.S. PATENT DOCUMENTS

| | | | |
|---|---|---|---|
| 4,579,614 | A | 4/1986 | Burmeister et al. |
| 2004/0231301 | A1 | 11/2004 | VanderTuin et al. |

FOREIGN PATENT DOCUMENTS

| | | | |
|---|---|---|---|
| FR | 1574464 | A | 7/1969 |

OTHER PUBLICATIONS

European Search Report for EP 14159444.0 dated Jul. 22, 2014.

*Primary Examiner* — Gregory A Wilson
(74) *Attorney, Agent, or Firm* — Levenfeld Pearlstein, LLC

(57) ABSTRACT

A heat shrink tunnel with width adjustment includes a pair of opposing side wall assemblies, each assembly including an outer wall and an inner perforated wall defining a plenum therebetween. The opposing side walls define a product path therebetween having a longitudinal axis. The side wall assemblies are movable toward and away from the axis. A heater/blower assembly is disposed in each of the opposing side walls, each having an outlet directed into the product path and drawing air from the product path, through its respective plenum. A top wall extends between the pair of opposing side wall assemblies and has an adjustable width to accommodate movement of the side wall assemblies.

25 Claims, 5 Drawing Sheets

SHRINK WRAP TUNNEL WITH DYNAMIC WIDTH ADJUSTMENT

BACKGROUND

Devices are known for wrapping or securing items for handling, transport and the like. Often, multiple items are placed together, bundled and a shrink wrap material is positioned around the items. The shrink wrap material is then heated to shrink around the bundled load. Such shrink wrap maintains the stability of the load and can provide protection against environmental conditions, such as water, dirt and the like.

Heating the shrink wrapped load is often carried out in a shrink wrap tunnel. Typically, a load to be shrink wrapped is presented to the tunnel on a conveyor. The load is wrapped with the material, which shrinks when subjected to heat. The load is conveyed through the tunnel and as it moves through the tunnel, heat, typically applied by forced air heaters, is blown over the wrapped load. The heat is sufficient to shrink the wrap onto the load to create a tightly wrapped package.

Known shrink wrap tunnels, include stationary walls. Because the heating elements are mounted to the walls, they too are stationary relative to the load moving through the tunnel, regardless of the size, or width of the load.

Loads, however, can consist of a wide variety of items, materials and the like, of a likewise wide variety of sizes. As such, there can be significant inefficiencies in heat shrink tunnels, especially when, for example, a narrow load is conveyed through a relatively wide tunnel. That is, the tunnel may be quite large, and the load much smaller. Thus, there are thermal losses and inefficiencies due to convective losses.

Accordingly, there is a need for a shrink wrap tunnel that reduces the inefficiencies inherent in the shrink wrapping process. Desirably, such a shrink wrap tunnel has a width that can be varied to accommodate loads having a variety of widths. More desirably, in such a shrink wrap tunnel, hot air can be directed or forced into open spaces around a wrapped load and drawn from the wrapped load, to minimize heat losses.

SUMMARY

A heat shrink tunnel has dynamic width adjustment. The tunnel includes a pair of opposing side wall assemblies. Each assembly includes an outer wall and an inner perforated wall that define a plenum therebetween. The opposing side walls define a product path therebetween, that defines a longitudinal axis through the tunnel. The side wall assemblies being movable toward and away from the longitudinal axis to vary the width of the product path.

A heater/blower assembly is disposed in each of the opposing side walls. Each heater blower assembly has an outlet directed into the product path and draws air from the product path, through its respective plenum.

A top wall extends between the pair of opposing side wall assemblies and has an adjustable width to accommodate movement of the side wall assemblies.

In a present embodiment, the heat shrink tunnel has a conveyor for moving product through the tunnel. The conveyor can define a floor for the heat shrink tunnel. The conveyor can include a conveying element, such as a belt, that is narrower than the distance between the tunnel walls and the conveyor width can be adjustable to, for example, accommodate the product width.

The top wall can be formed having an accordion-fold configuration to permit adjustment of the width thereof.

The tunnel can include front and rear walls at the entrance to and exit from the tunnel. The front and rear walls can be operably connected to one or both of the side wall assemblies and can likewise have an adjustable width to accommodate movement of the side wall assemblies.

The height of the front and rear walls can be adjustable to vary the height of the entrance to and exit from the tunnel. In such an embodiment, the front and rear walls can be formed having an accordion-fold configuration to permit adjustment of the width of the front and rear walls, respectively.

The inner perforated walls are preferably formed from or coated with a low-stick or non-stick material to reduce the opportunity for shrink wrap material to stick to the walls. Insulation can be disposed at about the outer walls to reduce heat losses.

In one contemplated embodiment, heat shrink tunnel includes a controller. In such an embodiment, one or more drives can be configured for moving the side wall assemblies toward and away from the longitudinal axis. Such an embodiment can include sensors for sensing the width of the load, and the side wall assemblies can be moved, such as by the drives, in response to the sensed width of the load.

These and other features and advantages of the present invention will be apparent from the following detailed description, in conjunction with the appended claims.

DETAILED DESCRIPTION

While the present device is susceptible of embodiment in various forms, there is shown in the figures and will hereinafter be described a presently preferred embodiment with the understanding that the present disclosure is to be considered an exemplification of the device and is not intended to be limited to the specific embodiment illustrated.

Figure 1:
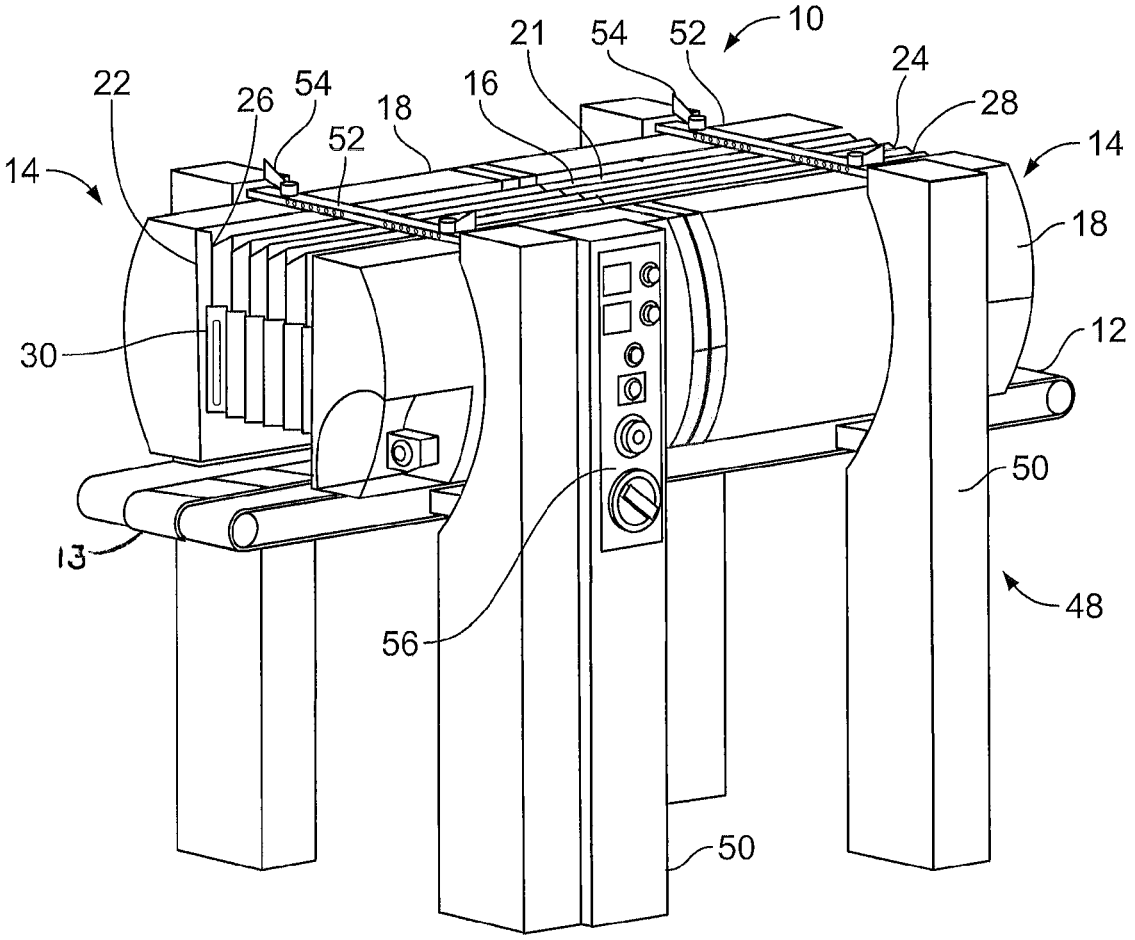
FIG. 1 is a perspective view of a shrink wrap tunnel with dynamic width adjustment.

Referring to the figures and in particular to FIG. 1 there is shown an exemplary shrink wrap tunnel 10 with dynamic width adjustment. The tunnel 10 is typically associated with a conveyor 12 to convey a load L through the tunnel 10. The conveyor 12 can define a bottom wall or floor for the tunnel 10. The conveyor can include a conveying element 13, such as a belt, chain, or other conveying medium for moving the load L or product through the tunnel 10. The conveyor 12 width can be adjustable to, for example, accommodate the product L width.

The tunnel 10 includes a pair of side wall assemblies 14 and a top or ceiling 16. The side wall assemblies 14 are moveable toward and away from each other (or a centerline $A_{12}$ of the conveyor 12) so as decrease or increase the distance $d_{14}$ between the walls 14. In a present embodiment, the side wall assemblies 14 include outer walls 18 that are curved, bowing outward at about the middle of the walls (as indicated at 20) and inward at the lower and upper junctions with the floor (or conveyor 12) and top 16, respectively.

The top 16 is configured so that it expands and collapses to maintain a closed ceiling as the side wall assemblies 14 are moved outwardly and inwardly. In a present embodiment, the top 16 is configured with an accordion panel 21 that expands and contracts to accommodate the movement of the side wall assemblies 14. Other wall expansion and contraction configurations can be provided to accommodate side wall assembly movement. For example, sliding panels can also be used.

In a present embodiment front and rear walls 22, 24 can be provided for the tunnel 10. The front and rear walls 22, 24 can also be configured to accommodate side wall assembly 14 movement by use of accordion walls/panels 26, 28 as shown, sliding panels and the like. In addition the front and rear walls 22, 24 can also include panels (front 30 shown, rear not shown) that allow for adjusting the height h of the tunnel opening O. As illustrated in FIG. 1, the panels (front 30 shown, rear not shown) can slide upward and downward to increase and decrease the height h of the tunnel opening O. It will be appreciated that the adjustment of the tunnel opening O height h will allow for minimizing heat losses from the tunnel 10.

The side wall assemblies 14 each include an inner wall 34 that, with their respective outer walls 18 each define an air plenum 36. The inner walls 34 are perforated or foraminous, as indicated at 38, to permit air flow between the tunnel 10 and the plena 36. In a present configuration, the inner, perforated walls 34 are formed from or coated with a low-stick or non-stick material, such as a metal coated with, for example, a Teflon® material coating to prevent shrink wrap material or debris from sticking to the walls 34, which could otherwise reduce airflow through the walls 34.

Figure 3:
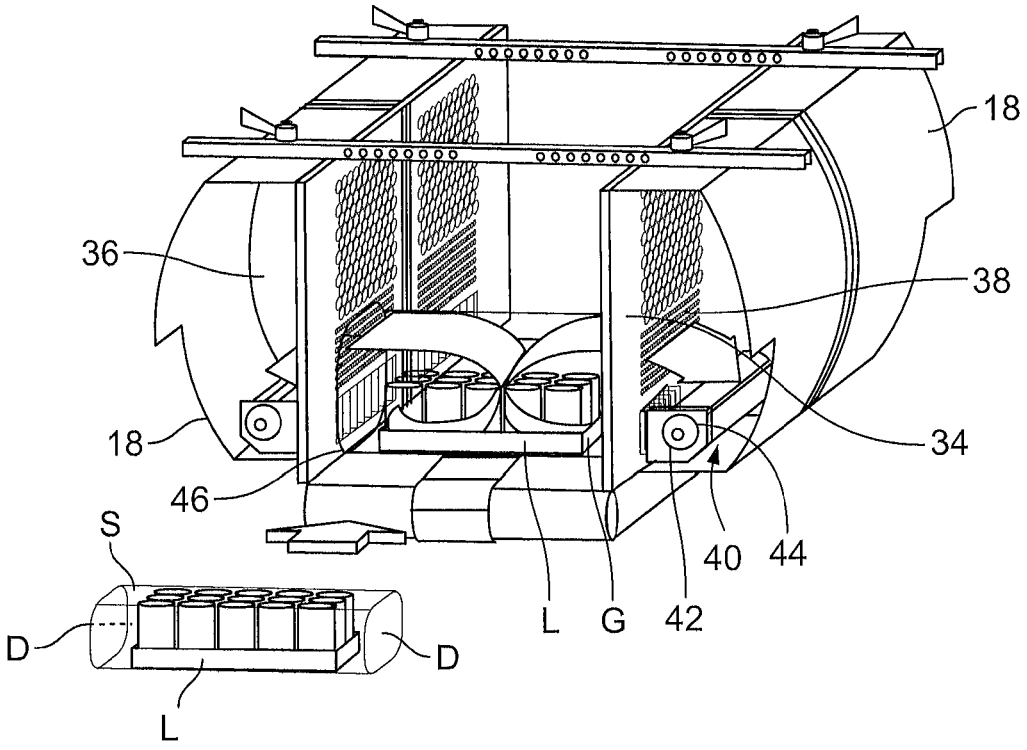
FIG. 3 is a perspective view of a portion of the shrink wrap tunnel shown broken away and showing a load positioned on the conveyor.
Figure 4:
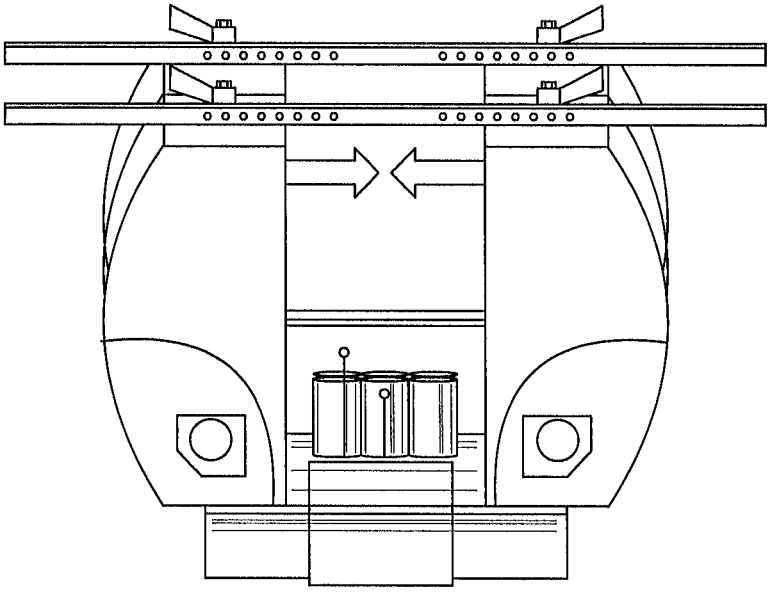
FIGS. 4 and 5 are front side illustrations of the tunnel showing the tunnel width being increased and decreased.
Figure 5:
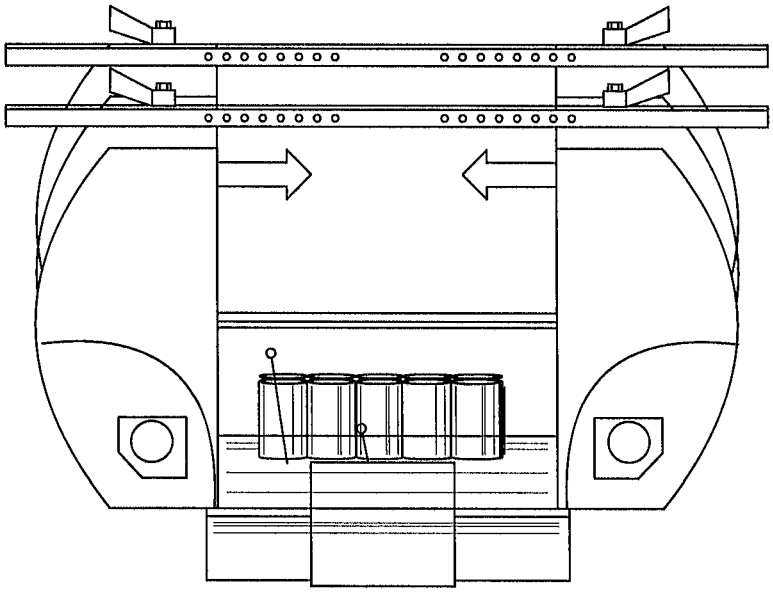
Figure 6:
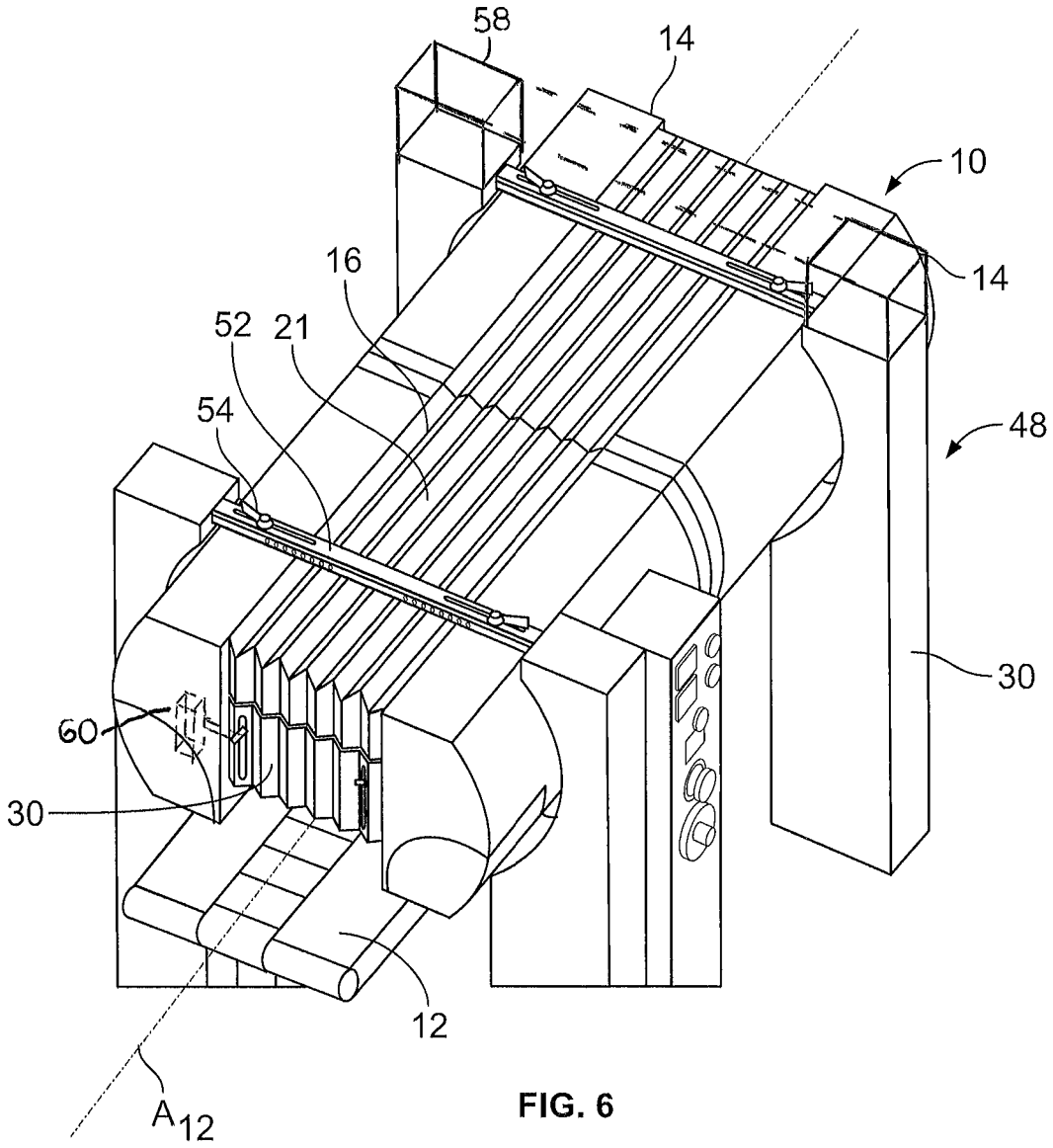
FIG. 6 is another perspective view of the shrink wrap tunnel.

A heater/blower assembly 40 is positioned in each of the side wall assemblies 34, in each plenum 36. As seen in FIG. 3, the heater/blower assembly 40 is located between the inner 34 and outer 18 walls near the bottom of the plenum 36. The heater/blower assembly 40 includes a centrifugal blower or fan 42 and a heat source 44. Outlet vents 46 are positioned at the outlet of each of the assemblies 40. In a present embodiment the heat source 44 is an electric heater, such as a resistance wire heater. Other suitable heat sources will be recognized by those skilled in the art.

Figure 2:
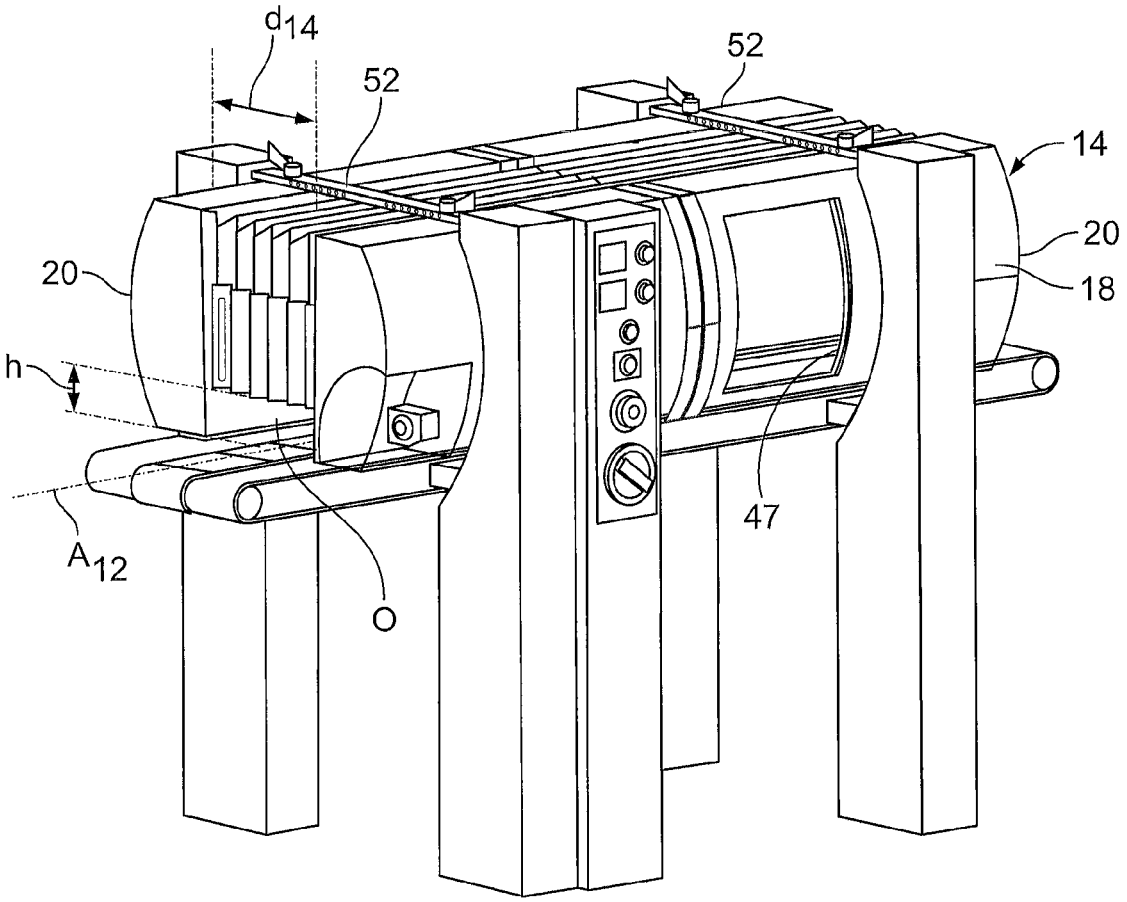
FIG. 2 is a view similar to FIG. 1, and showing a portion of the side wall out wall broken away.

As seen in FIG. 2, the tunnel 10 can include a layer of insulation 47 within the side wall assemblies 14. In a present embodiment the insulation 47 is present in the inside of the outer side wall 18 (on the plenum 36 side of the outer side wall 18) to further reduce heat losses from the tunnel 10 through the side wall assemblies 14.

The shrink tunnel 10 and conveyor 12 system can be mounted to a frame 48, such as that shown in FIG. 1. Support rails 52, mounted to the frame 48, can be configured to support the tunnel side wall assemblies 14 and or the top wall 16, to facilitate movement of the side wall assemblies toward and away from one another (decreasing and increasing the tunnel 10 width or distance $d_{14}$ between the side wall assemblies 14). The rails 52 can include locks 54 to lock the tunnel side wall assemblies 14 at a desired width $d_{14}$.

A controller 56 controls the overall operation of the tunnel 10. Operation can be manual or, optionally, various aspects of the tunnel 10 operation can be automatically controlled. For example, the internal temperature of the tunnel 10 can be monitored and controlled automatically, as can the speed at which the load L moves through the tunnel 10 (e.g., the conveyor 12 speed). It is also contemplated that further automatic operations can be incorporated into the present tunnel 10. For example, the width $d_{14}$ adjustment of the tunnel 10 as well as the height h adjustment of the front and rear walls 22, 24 may be carried out automatically. In such an arrangement, drives, such as servomotors or the like, such as indicated at 58 and 60, can drive the width $d_{14}$ adjustment and height h adjustment based upon the width and height of the load L as determined by sensors placed within the system 10.

In use, the width (i.e., distance $d_{14}$ between the side wall assemblies 14) and height h (e.g., front and rear wall openings O) of the tunnel 10 are first set. It is anticipated that a load L will be positioned on the conveyor 12 for presentation to the tunnel 10. As seen in FIG. 3, the load L will have a sleeve S of shrink wrap material positioned around the load L with the open sides D of the sleeve S directed toward the side wall assemblies 14. As the load L moves along the conveyor 12, hot air is forced from the heater/blower assembly 40 through the outlet vents and is directed into the wrapped load L. Because the tunnel side wall assemblies 14 are adjusted to contact or nearly contact the inner perforated wall 34 and the edges of the sleeve S, the hot air is essentially all directed into the sleeve S, rather than into the space around or outside of the load L within the tunnel 10.

Moreover, because air is drawn into the plenum 36 through the perforated plates 34, there is a higher pressure region created within the sleeve S, which further facilitates drawing the air from sleeve S around the load L. Essentially, a high pressure region is created at the blower 40 discharge with a low pressure region created within the plenum 36. In addition, because the sleeve S edge is positioned to contact or nearly contact the perforated wall 34, the hot air blown into the sleeved load L (see, e.g., FIG. 3), is drawn out at the top and bottom of the sleeve, thus facilitating the flow of heated air and rapid heat exchange to the shrink wrap material.

It will be appreciated by those skilled in the art that the relative directional terms such as upper, lower, rearward, forward and the like are for explanatory purposes only and are not intended to limit the scope of the disclosure.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present disclosure. It is to be understood that no limitation with respect to the specific embodiments illustrated is intended or should be inferred. The disclosure is intended to cover all such modifications as fall within the scope of the claims.

What is claimed is:

1. A heat shrink tunnel with width adjustment, comprising:

a pair of opposing side wall assemblies, each assembly including an outer wall and an inner perforated wall defining a plenum therebetween, the opposing side walls defining a product path therebetween, the product path defining a longitudinal axis, the side wall assemblies being movable toward and away from the longitudinal axis;

a heater/blower assembly disposed in each of the opposing side walls, each heater blower assembly having an outlet directed into the product path, each heater/blower assembly drawing air from the product path, through its respective plenum; and a top wall extending between the pair of opposing side wall assemblies, the top wall having an adjustable width to accommodate movement of the side wall assemblies.

2. The heat shrink tunnel of claim 1 including a conveyor, the conveyor having a belt thereon and configured to convey items through the heat shrink tunnel.

3. The heat shrink tunnel of claim 2, wherein the conveyor has an adjustable width.

4. The heat shrink tunnel of claim 1 wherein the top wall is formed having an accordion-fold configuration to permit adjustment of the width thereof.

5. The heat shrink tunnel of claim 1 including a front wall at an entrance to the heat shrink tunnel.

6. The heat shrink tunnel of claim 5 wherein the front wall is operably connected to one or both of the side wall assemblies and wherein the front wall has an adjustable width to accommodate movement of the side wall assemblies.

7. The heat shrink tunnel of claim 6 wherein the front wall is formed having an accordion-fold configuration to permit adjustment of the width thereof and wherein the top wall is formed having an accordion-fold configuration to permit adjustment of the width thereof.

8. The heat shrink tunnel of claim 5 wherein a height of the front wall is adjustable to vary a height of the entrance to the heat shrink tunnel.

9. The heat shrink tunnel of claim 1 including a rear wall at an exit from the heat shrink tunnel.

10. The heat shrink tunnel of claim 9 wherein the rear wall is operably connected to one or both of the side wall assemblies and wherein the rear wall has an adjustable width to accommodate movement of the side wall assemblies.

11. The heat shrink tunnel of claim 10 wherein the rear wall is formed having an accordion-fold configuration to permit adjustment of the width thereof and wherein the top wall is formed having an accordion-fold configuration to permit adjustment of the width thereof.

12. The heat shrink tunnel of claim 9 wherein a height of the rear wall is adjustable to vary a height of the exit from the heat shrink tunnel.

13. The heat shrink tunnel of claim 1 including insulation disposed at about the outer walls.

14. The heat shrink tunnel of claim 1 wherein the inner perforated walls are formed from or coated with a low-stick or non-stick material.

15. The heat shrink tunnel of claim 1 including a controller.

16. The heat shrink tunnel of claim 15 including one or more temperature controllers for controlling a temperature of the air inside of the tunnel.

17. The heat shrink tunnel of claim 15 including one or more drives for moving the side wall assemblies toward and away from the longitudinal axis.

18. The heat shrink tunnel of claim 17 including sensors for sensing a width of a load, the side wall assemblies being movable in response to the sensed width of the load.

19. A heat shrink tunnel with width adjustment, comprising:

a pair of opposing side wall assemblies, each assembly including an outer wall and an inner perforated wall defining a plenum therebetween, the opposing side walls defining a product path therebetween, the product path defining a longitudinal axis, the side wall assemblies being movable toward and away from the longitudinal axis;

a heater/blower assembly disposed in each of the opposing side walls, each heater blower assembly having an outlet directed into the product path, each heater/blower assembly drawing air from the product path, through its respective plenum;

a top wall extending between the pair of opposing side wall assemblies, the top wall having an adjustable width to accommodate movement of the side wall assemblies;

a conveyor, the conveyor configured to convey items through the heat shrink tunnel;

a front wall at an entrance to the heat shrink tunnel; and a rear wall at an exit from the heat shrink tunnel.

20. The heat shrink tunnel of claim 19 wherein the front wall and the rear wall are operably connected to one or both of the side wall assemblies and front wall and the rear wall have an adjustable width to accommodate movement of the side wall assemblies.

21. The heat shrink tunnel of claim 20 wherein the top wall, front wall and rear wall are each formed having an accordion-fold configuration to permit adjustment of the width of the product path.

22. The heat shrink tunnel of claim 21 wherein a height of the front wall is adjustable to vary a height of the entrance to the heat shrink tunnel and wherein a height of the rear wall is adjustable to vary a height of the exit from the heat shrink tunnel.

23. The heat shrink tunnel of claim 19 wherein the conveyor defines a floor for the heat shrink tunnel.

24. The heat shrink tunnel of claim 19 wherein the conveyor includes a conveying element and wherein the conveying element is narrower than a floor of the heat shrink tunnel.

25. The heat shrink tunnel of claim 19 wherein the conveyor has a width that is adjustable.

* * * * *